US010920513B2

(12) United States Patent
Blakey et al.

(10) Patent No.: US 10,920,513 B2
(45) Date of Patent: Feb. 16, 2021

(54) COMPOSITE PERMANENT PACKER SPACER SYSTEM

(71) Applicant: HALLIBURTON ENERGY SERVICES, INC., Houston, TX (US)

(72) Inventors: Joseph G. Blakey, Tuttle, OK (US); John H. Hales, Oklahoma City, OK (US)

(73) Assignee: Halliburton Energy Services, Inc., Houston, TX (US)

( * ) Notice: Subject to any disclaimer, the term of this patent is extended or adjusted under 35 U.S.C. 154(b) by 50 days.

(21) Appl. No.: 16/301,502

(22) PCT Filed: Jul. 19, 2016

(86) PCT No.: PCT/US2016/042979

§ 371 (c)(1),
(2) Date: Nov. 14, 2018

(87) PCT Pub. No.: WO2018/017065

PCT Pub. Date: Jan. 25, 2018

(65) Prior Publication Data

US 2020/0181995 A1 Jun. 11, 2020

(51) Int. Cl.

| | |
|---|---|
| ***E21B 23/06*** | (2006.01) |
| ***E21B 33/129*** | (2006.01) |
| ***E21B 33/12*** | (2006.01) |
| ***E21B 33/128*** | (2006.01) |
| ***E21B 33/134*** | (2006.01) |

(52) U.S. Cl.

CPC ..... *E21B 23/06* (2013.01); *E21B 33/1293* (2013.01); *E21B 33/1208* (2013.01); *E21B 33/128* (2013.01); *E21B 33/134* (2013.01); *E21B 2200/06* (2020.05)

(58) Field of Classification Search

CPC ..... E21B 33/1204; E21B 37/08
See application file for complete search history.

(56) References Cited

U.S. PATENT DOCUMENTS

| | | | | |
|---|---|---|---|---|
| 2,715,444 | A * | 8/1955 | Fewel | E21B 33/124 166/147 |
| 4,279,306 | A * | 7/1981 | Weitz | E21B 37/08 166/147 |
| 4,567,944 | A | 2/1986 | Zunkel et al. | |
| 4,569,396 | A | 2/1986 | Brisco | |
| 4,590,995 | A | 5/1986 | Evans | |
| 4,640,351 | A | 2/1987 | Clifton et al. | |
| 4,962,815 | A | 10/1990 | Schultz et al. | |

(Continued)

OTHER PUBLICATIONS

Halliburton Energy Services, Inc., Tools Operations Manual, "EZ DRILL(R) SV Squeeze Packer," pp. 1-7, May 1997.

(Continued)

*Primary Examiner* — Kristyn A Hall
*Assistant Examiner* — Dany E Akakpo
(74) *Attorney, Agent, or Firm* — McAfee & Taft

(57) ABSTRACT

A downhole tool for shutting off perforations has upper and lower sealing assemblies. A spacer separates the upper and lower sealing assemblies. The upper and lower sealing assemblies may engage a well above and below perforations to be shut off. A settable material may be injected into a space between the upper an lower assemblies, and into the perforations.

20 Claims, 6 Drawing Sheets

(56) References Cited

U.S. PATENT DOCUMENTS

| | | | | |
|---|---|---|---|---|
| 5,184,677 | A | 2/1993 | Dobscha et al. | |
| 5,197,543 | A | 3/1993 | Coulter | |
| 6,394,180 | B1 | 5/2002 | Berscheidt et al. | |
| 6,766,858 | B2 | 7/2004 | Nguyen et al. | |
| 6,883,610 | B2 | 4/2005 | Depiak | |
| 7,647,980 | B2 | 1/2010 | Corre et al. | |
| 8,511,383 | B2 | 8/2013 | Stewart et al. | |
| 8,631,872 | B2 | 1/2014 | East, Jr. | |
| 8,807,210 | B2 | 8/2014 | Smith et al. | |
| 8,839,869 | B2 | 9/2014 | Porter et al. | |
| 9,169,704 | B2 | 10/2015 | Dockweiler et al. | |
| 2003/0037932 | A1* | 2/2003 | Guillory | E21B 23/06 166/387 |
| 2004/0238218 | A1* | 12/2004 | Runia | E21B 10/60 175/57 |
| 2015/0007991 | A1* | 1/2015 | Larsen | E21B 33/14 166/285 |

OTHER PUBLICATIONS

International Search Report and Written Opinion dated Apr. 17, 2017, issued in corresponding PCT Application No. PCT/US2016/042979.

* cited by examiner

COMPOSITE PERMANENT PACKER SPACER SYSTEM

BACKGROUND

This disclosure is directed to an apparatus and method for filling, or plugging perforations in a well. There are a number of reasons for why it is desirable to isolate or plug perforations that have been made in a well. For example, zones may not be producing, and in some cases perforations are inadvertently placed at the wrong location. There are a number of ways to isolate zones, but generally to do so requires multiple trips in a well, and use temporary, or retrievable tools.

BRIEF DESCRIPTION OF THE DRAWINGS

FIG. 6 shows an embodiment of the tool with no slots in the spacer portion.

DESCRIPTION OF AN EMBODIMENT

Figure 1:
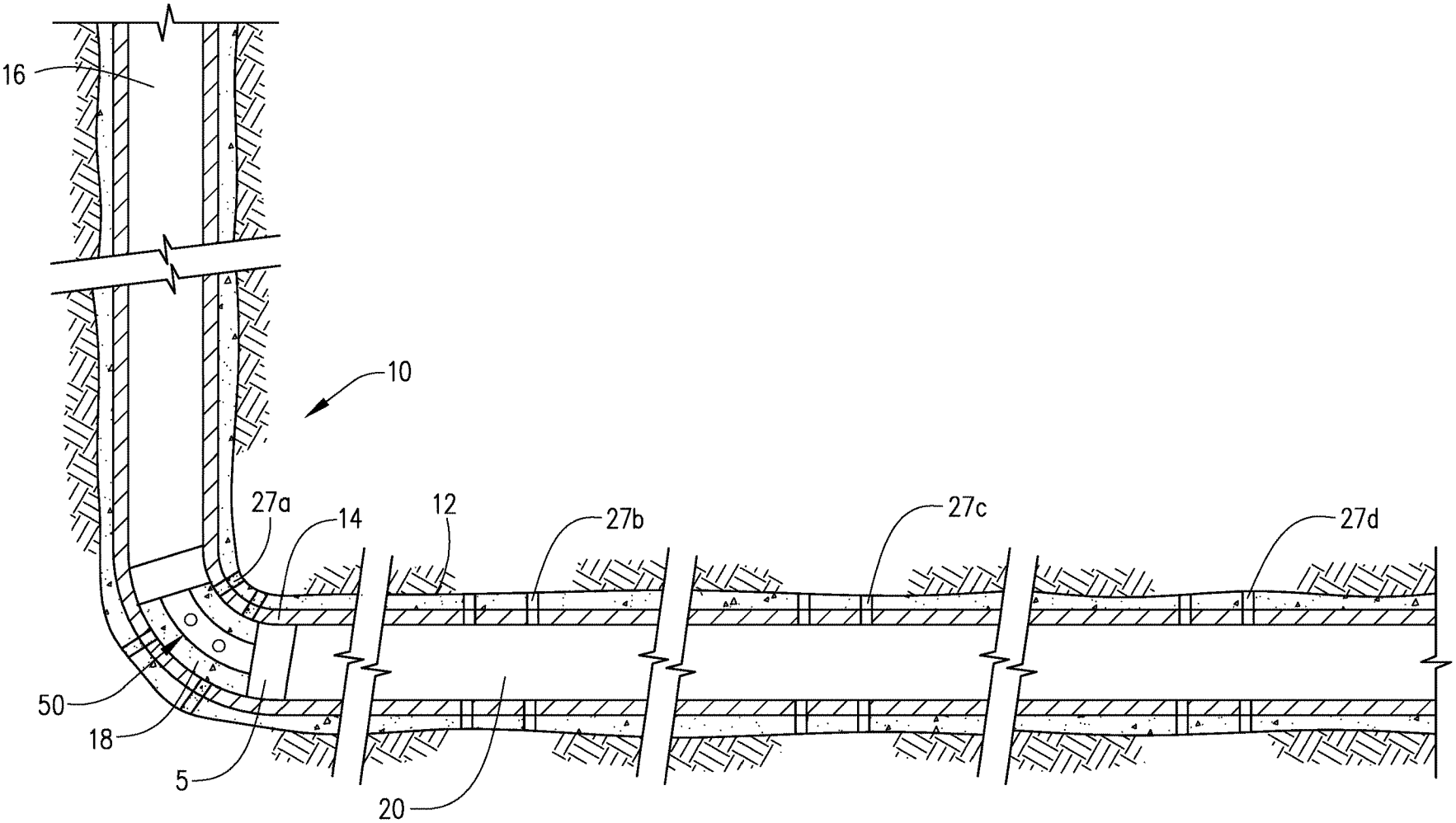
FIG. 1 schematically shows a downhole tool positioned in the well in a heel portion thereof.

In the drawings and descriptions that follow, like parts are typically marked throughout the specification and drawings with the same reference numerals respectively. The drawn figures are not necessarily to scale on certain features of the image, and may be shown exaggerated in scale or in somewhat schematic form. Some details of conventional elements may not be shown in the interest of clarity and preciseness. The present invention may be implemented in embodiments of different forms. The specific embodiments are described in detail and are shown in the drawings, with the understanding that the present disclosure is to be considered an exemplification of the principles of the invention and is not intended to limit the invention to that illustrated and described herein. It is to be fully recognized that the different teachings of the embodiments discussed herein may be employed separately or in any suitable desired combination. Unless otherwise specified, use of the terms "connect," "engaged," "coupled," "attached," or any other like term describing an interaction between elements is not meant to limit the interaction to direct interaction between the elements and may also include indirect interaction between the elements described. Unless otherwise specified, use of the terms "up," "upward," "uphole," "upstream," or other like terms should be construed as generally toward the surface. Likewise, use of the terms "down," "lower," "downward," "downhole," or other like terms should be construed generally toward the bottom, terminal end of the well, regardless of the wellbore orientation.

Unless otherwise specified, use of the term "subterranean formation" shall be construed as encompassing both areas below exposed earth and areas below earth covered by water, such as, ocean or fresh water.

Referring to FIG. 1, an exemplary environment of an embodiment of the methods, systems and apparatus disclosed herein is depicted. Unless otherwise stated, the horizontal, vertical or deviated nature of any figure is not to be construed as limiting the wellbore to any particular configuration.

A downhole tool 5 is shown disposed in a well 10. Well 10 comprises a wellbore 12 and a casing 14 therein. Well 12 may have a vertical portion 16, a heel or transition portion 18 and a lateral or horizontal portion 20. Lateral or horizontal portion 20 may also he referred to as a deviated wellbore portion.

Well 12 may include a plurality of perforations 27 therein. Perforations are shown designated with letters a, b, c and d to distinguish therebetween. As depicted in figures, perforations 27*a* are in the heel or transition portion 18 of the well 12. Such perforations typically occur inadvertently and oftentimes require a casing patch or other remedial repair and other perforations that are to be filled or blocked for any reason. This disclosure provides a tool and method for filling, or patching perforations 27*a* that are placed in the heel portion 18 of well 10. A typical repair, or plug may have a casing patch which is left in the wellbore and permanently reduces the inner diameter of the casing. Another common repair uses a bridge plug set below the perforations above and a retainer or other barrier above the perforations so that cement may be pumped between the two. This requires multiple trips in and out of the wellbore to accomplish. The current disclosure provides a method and apparatus which can plug, or patch perforations with a single trip, without reducing the inner diameter of the casing.

Downhole tool 5 comprises a packer assembly 30 with a central bore or passageway 32 therethrough. Packer assembly 30 has an upper end 34 which may be connected to a setting tool 36 of a type known in the art. Packer assembly 30 has a lower end 38.

Downhole tool 5 includes mandrel 40 with upper end 34 and outer surface 42 that defines outer diameter 43. The setting tool 36 will have outer and inner sleeves, as shown, and the inner sleeve will provide an upward pull on the packer mandrel 40, which will move the packer assembly 30 into the set position as described herein. Packer mandrel 40 has ports 46 defined therethrough communicated with flow passage 32, and an undercut 48 in outer surface 42. A spacer 50 has upper end 52 and lower end 54 and is slidably disposed about mandrel 40. Spacer 50 has an outer diameter 56 that is larger than an outer diameter 43 of mandrel 40. Spacer 50 has an undercut 58 in inner surface 60 thereof. Mandrel 40 has a port 61 defined through the wall thereof and near the lower end thereof. In the position shown in FIG. 4, no flow through port 61 is permitted. Tool 5 may be moved to a position in which flow through port 61 is permitted, as depicted in FIG. 5.

Figure 4:
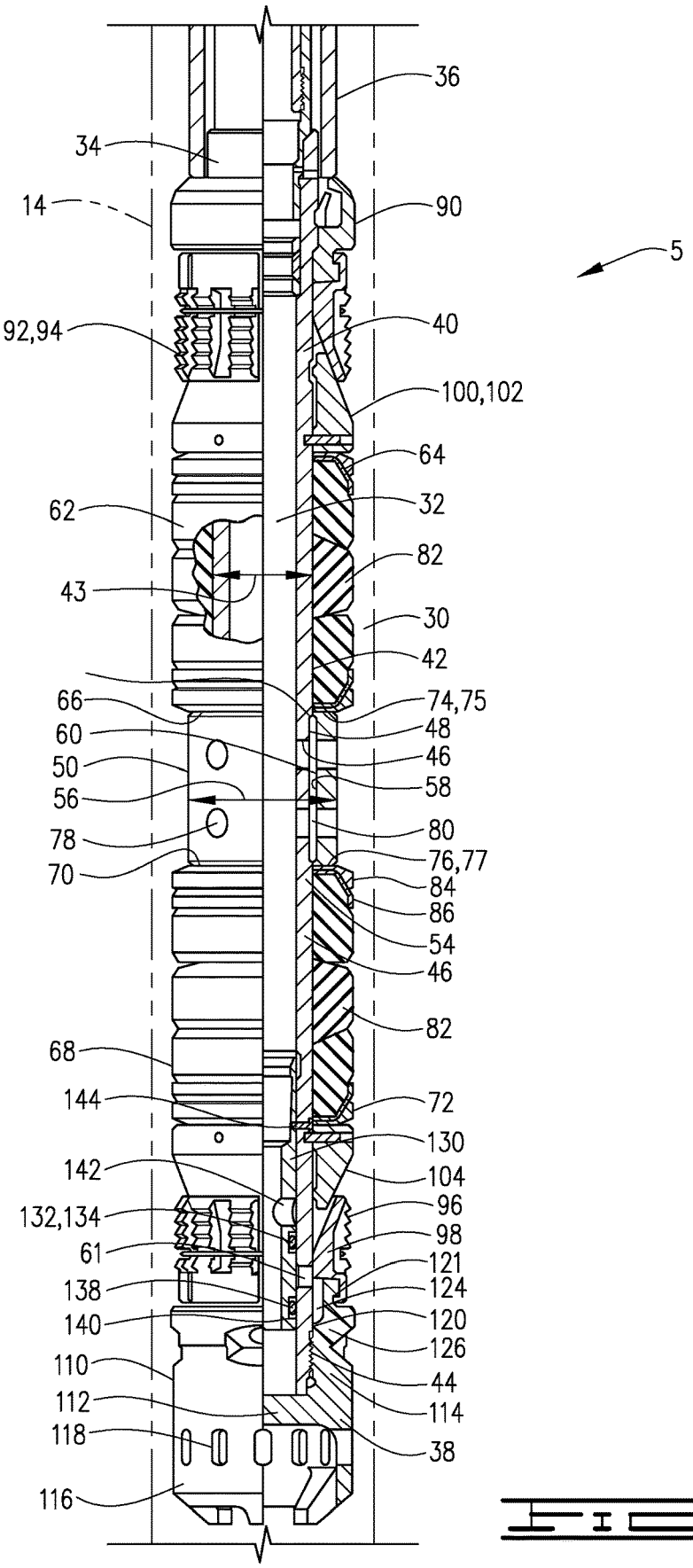
FIG. 4 shows a partial cross-section view of the tool in an unset position with an open flow path through an end thereof.

Packer assembly 30 further comprises an upper sealing assembly 62 with upper end 64 and lower end 66. A second or lower sealing assembly 68 is axially spaced from upper sealing assembly 62 and has upper end 70 and lower end 72. Upper sealing assembly 62 and lower sealing assembly 68 are moveable from an unset position as shown in FIG. 4 to a set position as shown in FIG. 5. Both of upper and lower sealing assemblies 62 and 68 are moveable from the unset to the set position utilizing single setting tool 36.

Spacer 50 is positioned between upper and lower sealing assemblies 62 and 68. Spacer 50 has upper and lower ends 74 and 76 that provide abutments, or shoulders 75 and 77 for upper and lower sealing assemblies 62 and 68. Upper shoulder 74 abuts lower end 66 of upper sealing assembly 62, while lower shoulder 76 abuts the upper end 70 of lower sealing assembly 68. Spacer 50 defines at least one and preferably a plurality of slots or ports 78 therethrough. Undercuts 48 and 58 define a space 80 therebetween, Upper and lower sealing assemblies 62 and 68 each comprise at least one and preferably a plurality of sealing elements 82. Shoes 84 along with shoe retainers 86 are positioned at the upper and lower ends of sealing assemblies 62 and 68.

Figure 5:
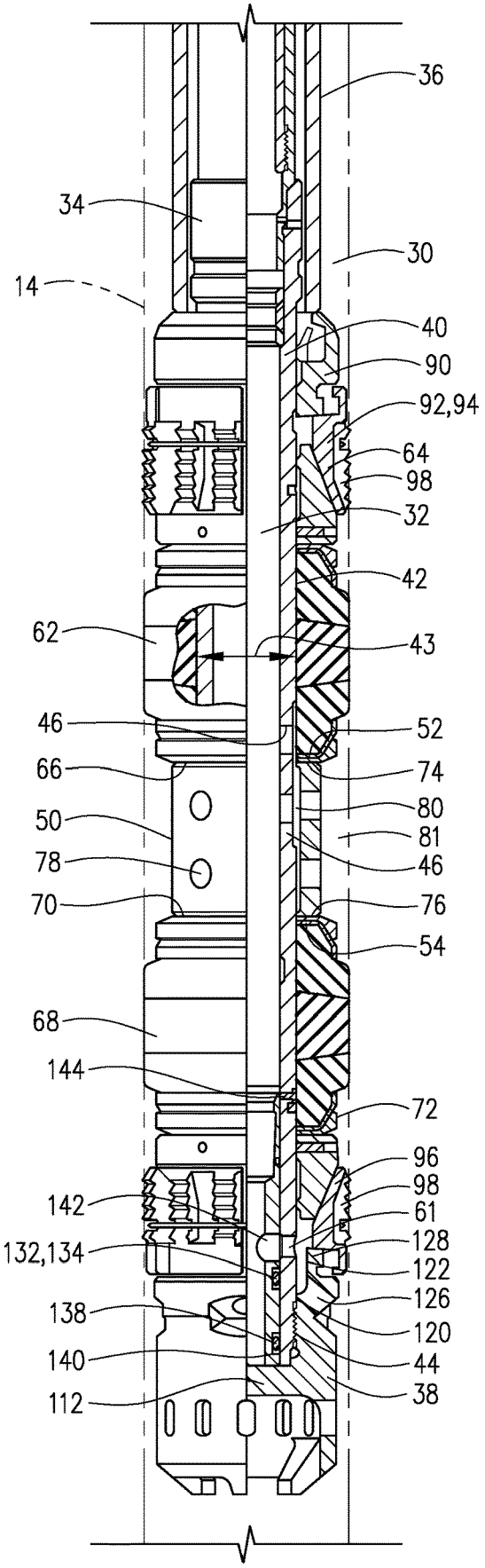
FIG. 5 shows a partial cross section of the tool in a set position.
Figure 5:
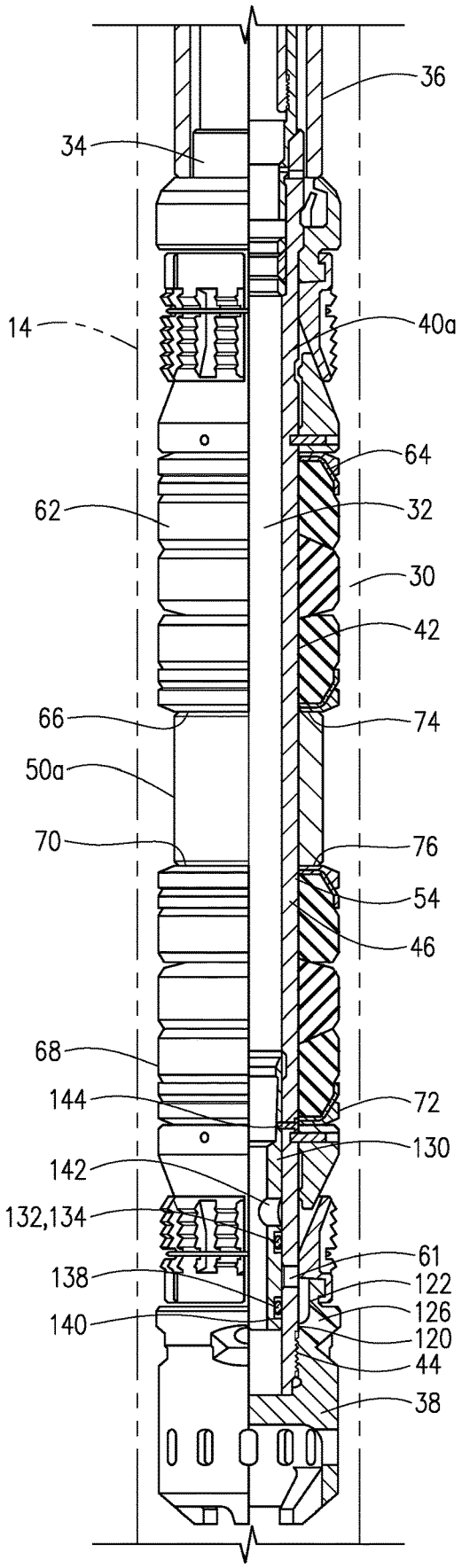

When upper and lower sealing assemblies 62 and 68 are moved from the unset position shown in FIG. 4 to the set position shown in FIG. 5 in which the sealing elements engage well 10, a space 81 between upper and lower sealing assemblies 62 and 68 is isolated from the remainder of the well 10. Space 81 is a generally annular space.

A spacer ring 90 is disposed about mandrel 40 above upper sealing assembly 62. Tool 5 has slip rings 92 which comprise upper and lower slip rings 94 and 96 respectively. Slip rings 92 each comprise a plurality of slip segments 98 for grippingly engaging casing 14. Slip segments 98 may be of a type known in the art. Spacer ring 90 may serve to provide an abutment to axially retain slip segments 98 which are positioned circumferentially about mandrel 40. Slip wedges 100, which comprise upper and lower slip wedges 102 and 104 respectively, are positioned in a slidable relationship to and partially underneath slip rings 94 and 96 respectively. Slip wedges 102 and 104 may initially be pinned or otherwise fixed to mandrel 40. Slip retaining bands 108 may be utilized to hold slip segments 98 in place circumferentially around mandrel 40 prior to the tool 5 moving from the unset to the set position in which the slip rings 94 and 96 expand radially outwardly to engage the well 10.

Downhole tool 5 further comprises a bottom sub 110 threaded to the lower end 38 of mandrel 40. Bottom sub 110 has a bottom plate 112 that extends across and blocks passageway 32 so that flow therethrough is prevented. Bottom plate 112 separates lower sub 110 into an upper portion 114 and lower portion 116. Lower portion 116 includes a plurality of ports 118 that are spaced circumferentially thereabout. Upper portion 114 defines first and second inner diameters 120 and 122 respectively. Second inner diameter 122 is greater than first diameter 120 so that an annular space 124 is defined between mandrel 40 and the upper portion 114 of lower sub 110. A flow port 126 extends through a wall 128 of upper portion 114 and intersects annular space 124 to communicate annular space 124 with well 10.

A moveable sleeve 130 which may be a collet 130 is closely received in passageway 32 in mandrel 40. First and second or upper and lower O-ring seals 132 and 138 are disposed in grooves 134 and 140 respectively on an outer surface of moveable sleeve 130. O-ring seals 132 and 138 seal against mandrel 40 and are positioned above and below port 61, which extends through mandrel 40 and which intersects or is communicated with annular space 124. Both seals are positioned below a port 142 in collet 130. In the position shown in FIG. 4, no flow is permitted through port 142.

As shown in FIG. 5, flow through port 142 may he established by moving collet 130 so that port 142 communicates with port 61 Which communicates with annular space 124 and port 126. Sleeve 130 may be moved mechanically, or by other means. Initially, sleeve 130 is held in place by shear pins 144. If it is desired to open a flow path, sleeve 130 is moved so that it shifts downwardly to allow communication from port 142 through ports 61 in mandrel 40 and flow port 126 in lower sub 110. Once sleeve 130 has shifted, flow of fluid may be passed from flow passageway 32 into the well 10 through port 126. While sleeve 130 is shown in an open position in FIG. 5, it is understood that the sleeve will be in a closed position when the tool is in the set position, unless it is desired to establish flow to the well below the tool 5.

Downhole tool 5 described herein may be utilized for shutting, closing off or patching perforations in a well. In many instances, perforations are inadvertently made in the heel portion of a well. Such a scenario is schematically shown in FIG. 1. As shown therein downhole tool 5 may be lowered into well 10 and positioned in a desired location in the well to patch, or close off perforations. In FIG. 1, downhole tool 5 is positioned at heel 18 of well 10 such that spaced apart upper and lower sealing assemblies 62 and 68 straddle perforations 27*a*.

Once lowered into the well to the desired location, downhole tool 5 is moved from the unset to the set position so that upper and lower sealing assemblies 62 and 68 engage casing 14. A setting tool 36 of a type known in the art may be used to move the tool 5 from the unset to the set positions. Mandrel 40 will move relative to spacer 50. Activating setting tool 36 will cause sub 110 to move upwardly so that slip rings 94 and 96 will move over slip wedges 102 and 104, and slip wedges 102 and 104 along with shoulders 74 and 76 will cause sealing assemblies 62 and 68 to expand. As a result, slip rings 94 and 96 will grippingly engage casing 14, and sealing assemblies 62 and 68 will seal against casing 14. In the set position, annular space 81 is isolated from the rest of well 10 by upper and lower sealing assemblies 62 and 68. In the embodiment of FIG. 1, slatted spacer 50 is utilized so that once tool 5 is in place, a settable fluid such as cement or epoxy may be pumped into flow passageway 32 through setting tool 36. The settable material will pass into and through slots 78 and will fill annular space 81 around spacer 50 between the upper and lower sealing assemblies 62 and 68. A sufficient quantity of the settable material may be pumped therein to ensure that settable material actually extends outwardly into the perforations. The settable material may thus be squeezed into the perforations or damaged casing, and subsequently into the formation. Once a sufficient amount of settable material has been pumped through slots 78, flow is stopped and the settable material allowed to cure or set for a necessary time period. Once the settable material has cured tool 5, which is preferably comprised of a drillable material, can be drilled out. Once the tool is drilled out the well 10 has a clean well passage. The component parts of tool 5 may be comprised of composites or other drillable materials.

Figure 2:
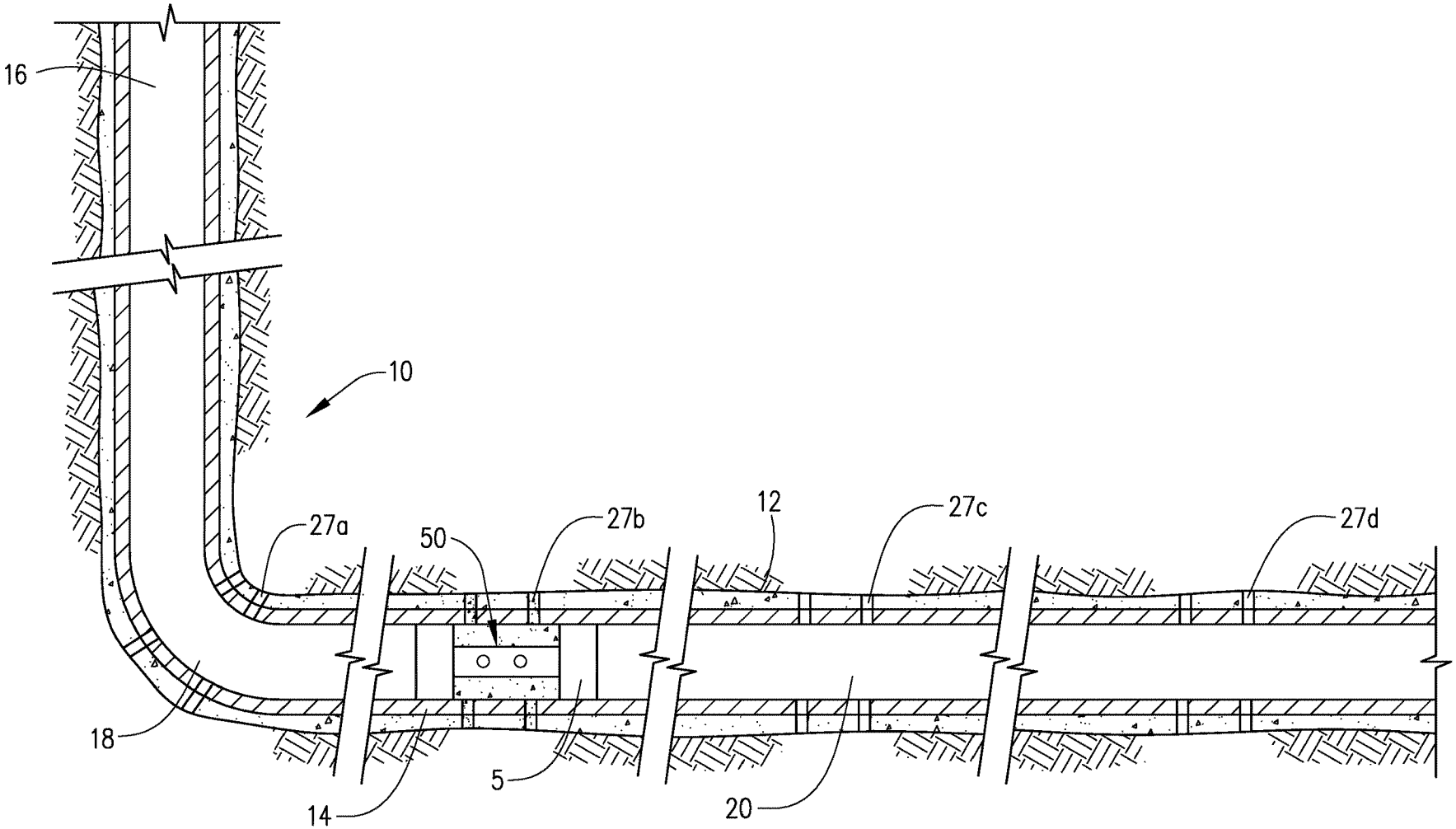
FIG. 2 shows an embodiment of the tool of FIG. 1 in the lateral portion of the well and configured to shut off flow from perforations.
Figure 3:
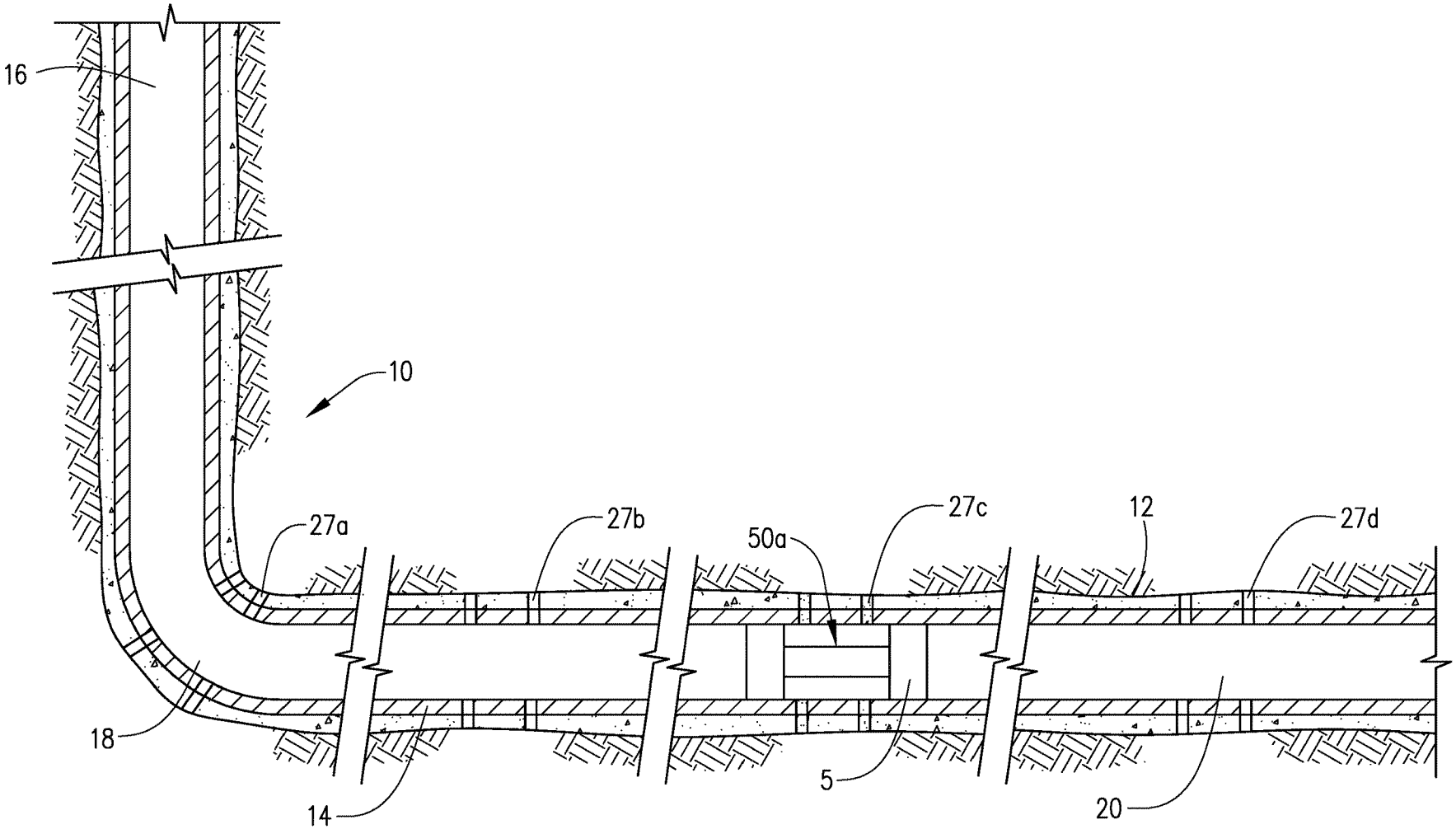
FIG. 3 shows an additional embodiment of the tool in a well. The embodiment of FIG. 3 does not have ports in the spacer section thereof.

If it is desired to plug or patch perforations in the lateral or horizontal portions of well 10 for any reason, the same process is followed. In FIG. 2 tool 5 is shown in lateral well portion 20 in which settable material is shown disposed in annulus 81 and filling perforations 72*b*. If desired, an embodiment of the tool such as that shown in FIG. 6 may be utilized. Downhole tool 5A in FIG. 6 is identical in all respects to downhole tool 5 except that instead of a spacer 50, tool 5A has a spacer 50A with no ports or slots and no undercut and has mandrel 40A with no ports 46 or undercut 48. The remainder of the elements are identified identically to those in the embodiment shown in FIG. 3 and are identical thereto. When the embodiment of FIG. 6 is utilized, tool 5A is set at the desired location in which upper and lower sealing assemblies 62 and 68 straddle perforations to be closed off Flow therefrom is stopped or prevented from flowing upwardly in the well 10 since there is no flow passage through spacer 50A and the upper and lower sealing assemblies 62 and 68 prevent flow. It may be desirable to close off perforations for any number of reasons. For example, perforations through which a formation produces primarily water, or simply to plug perforations that are no longer to be utilized. Inadvertently created perforations may also be closed off as described.

One embodiment may comprise the downhole tool 5 in which a two-part epoxy is utilized as a settable material. First and second components of the two-part epoxy may be included in the tool 5 that is lowered into the well and may be spaced apart in mandrel 40. First and second epoxy components may be mixed by applying pressure thereto and then pushed outward into the annulus 81 to fill the annulus 81 and to push the mixed epoxy into perforations 27 or other perforations in the well. The components may be separated, for example, by a barrier that can be removed during, or after the process of moving the tool from the unset to the set position in the well.

Thus, the apparatus of this disclosure may comprise a packer assembly with a first and second sealing assembly disposed about a mandrel, and moveable from an unset to a set position in which the first and second sealing assemblies engage the well. The second sealing assembly is axially spaced from the first sealing assembly and a single setting tool is configured to simultaneously move both of the first and second sealing assemblies from the unset to the set position in the well.

The mandrel may have ports therethrough. A spacer is positioned between the first and second sealing assemblies and is slidable relative to the mandrel. The spacer may have a plurality of ports therethrough to communicate a settable fluid into an annulus or annular space defined by and between the spacer and a casing in the well.

The downhole tool further has two slip rings and preferably only two slip rings which comprise a first and a second plurality of slip segments for grippingly engaging the well. A settable material may be disposed in the mandrel assembly prior to the mandrel assembly being positioned in the well and the settable material may comprise a two-part epoxy with first and second components. The first and second components may be positioned in the upper and lower mandrels of the mandrel assembly.

The apparatus may further comprise a slidable collet in the mandrel assembly that is moveable from a first to a second position. In the first or closed position, flow through the mandrel to the well below the second sealing assembly is blocked while in the second or open position flow is permitted therethrough.

The method of shutting or closing off perforations may thus comprise lowering. first and second sealing assemblies into the well, positioning the first sealing assembly above the perforations to be closed off, positioning the second sealing assembly below the perforations to be closed off and setting the first and second sealing assemblies with a single setting tool. The method may further comprise injecting a settable material into an annular space between the first and second sealing assemblies. The settable material may likewise be injected not only into the annular space but into the perforations to be closed off.

The method may comprise lowering first and second sealing assemblies into the well at the same time on a lowering tool and removing the lowering tool and further drilling out the first and second sealing assemblies after the settable material has been injected into the annulus and the perforations and has cured.

Although the disclosed invention has been shown and described in detail with respect to a preferred embodiment, it will be understood by those skilled in the art that various changes in the form and detailed area may be made without departing from the spirit and scope of this invention as claimed. Thus, the present invention is well adapted to carry out the object and advantages mentioned as well as those which are inherent therein. While numerous changes may be made by those skilled in the art, such changes are encompassed within the spirit of this invention as defined by the appended claims.

What is claimed is:

1. A downhole tool for use in a well comprising:

a mandrel having a mandrel flow passage;

a first sealing assembly disposed about the mandrel and moveable from an unset to a set position in which the first sealing assembly engages the well;

a second sealing assembly disposed about the mandrel and longitudinally spaced from the first sealing assembly, the second sealing assembly being moveable from an unset to a set position in which the second sealing assembly engages the well;

a single setting tool configured to simultaneously move both of the first and second sealing assemblies from the unset to the set position in the well;

a spacer positioned between the first and second sealing assemblies disposed about the mandrel and slidable relative thereto, the spacer and the well defining an annulus therebetween; and a settable material disposed in the mandrel flow passage, wherein the settable material comprises a two component settable material, the first and second components being positioned in the mandrel flow passage, and wherein both the first and second components are pumpable into the annulus and will set upon being mixed.

2. The downhole tool of claim 1, wherein the first and second components are spaced apart in the mandrel flow passage.

3. The downhole tool of claim 1, further comprising:

lower sub for preventing flow through the mandrel flow passage into the well below the second sealing assembly, wherein the lower sub includes a flow port; and a slidable collet moveable from a first position in which flow from the mandrel flow passage through the flow port and to the well below the second sealing assembly is blocked, to a second position in which flow is permitted.

4. The downhole tool of claim 1, wherein the spacer defining upper and lower shoulders, wherein the lower shoulder provides an abutment for an upper end of the second sealing assembly and the upper shoulder provides an abutment for the lower end of the first sealing assembly.

5. The downhole tool of claim 1, wherein the spacer defines a plurality of ports therethrough, and wherein the mandrel has ports therethrough for communicating a mandrel flow passage with the well between the first and second sealing assemblies through the ports in the spacer when the tool is in the set position in the well.

6. The downhole tool of claim 5, wherein the spacer defines upper and lower shoulders, wherein the lower shoulder provides an abutment for an upper end of the second sealing assembly and the upper shoulder provides an abutment for the lower end of the first sealing assembly.

7. The downhole tool of claim 6, further comprising:

a lower sub for preventing flow through the mandrel flow passage into the well below the second sealing assembly, wherein the lower sub includes a flow port; and a slidable collet moveable from a first position in which flow from the mandrel flow passage through the flow port and to the well below the second sealing assembly is blocked, to a second position in which flow is permitted.

8. The downhole tool of claim 7, wherein the first and second components are spaced apart in the mandrel flow passage.

9. A method of closing off perforations in a well comprising:

lowering a downhole tool into the well, the downhole tool comprising:

a mandrel having a flow passage;

a first sealing assembly disposed about the mandrel and moveable from an unset to a set position in which the first sealing assembly engages the well;

a second sealing assembly disposed about the mandrel and longitudinally spaced from the first sealing assembly, the second sealing assembly being moveable from an unset to a set position in which the second sealing assembly engages the well; and a settable material disposed in the mandrel flow passage, wherein the settable material comprises a two component settable material, the first and second components being positioned in the mandrel flow passage, and wherein both the first and second components are pumpable into the annulus and will set upon being mixed;

positioning the first sealing assembly above the perforations to be closed off;

positioning the second sealing assembly below the perforations to be closed off; and injecting the settable material into a space between the first and second sealing assemblies.

10. The method of claim 9, further comprising injecting the settable material into the perforations to be closed off.

11. The method of claim 10, further comprising:

lowering the first and second sealing assemblies into the well at the same time with a lowering tool;

removing the lowering tool; and drilling out the first and second sealing assemblies after the settable material has been injected into the annulus and the perforations.

12. The method of claim 9, further comprising longitudinally spacing the first and second sealing assemblies with a slotted spacer prior to the lowering step, the first and second components of the settable material are spaced apart in the mandrel flow passage, and injecting the settable material into the perforations through slots in the slotted spacer, the lowering step comprising lowering the first and second sealing assemblies and the spacer into the well with a lowering tool.

13. The method of claim 12, further comprising drilling out the first and second sealing assemblies after the settable material has cured.

14. The method of claim 9, wherein the perforations to be shut off are in a heel portion of a well.

15. An apparatus for closing off flow from perforations in a well comprising:

a non-retrievable first sealing assembly positioned in the well above the perforations;

a non-retrievable second sealing assembly positioned in the well below the perforations;

a spacer positioned between the first and second sealing assemblies, wherein an annulus is defined by and between the spacer and a casing in the well;

a lower sub for preventing fluid flow through a bore of the apparatus into the well below the second sealing assembly; and a settable material disposed in the bore, wherein the settable material comprises a two component settable material, the first and second components being positioned in the bore, and wherein both the first and second components are pumpable into the annulus and will set upon being mixed.

16. The apparatus of claim 15, wherein the spacer defines a plurality of ports therethrough.

17. The apparatus of claim 16, wherein the first and second components are spaced apart in the mandrel flow passage.

18. The apparatus of claim 15, wherein the first sealing assembly comprises:

a plurality of sealing elements disposed about a mandrel; and the second sealing assembly comprising a plurality of sealing elements disposed about the mandrel, the spacer having an outer diameter greater than the outer diameter of the mandrel and defining an abutment for the first and second sealing assemblies.

19. The apparatus of claim 18, further comprising a slidable collet moveable from a first position in which flow to the well below the second sealing assembly is blocked, to a second position in which flow is permitted.

20. The apparatus of claim 18, wherein the mandrel defines a plurality of ports therethrough positioned to communicate with the well through ports defined in the spacer when the tool is in a set position in the well.

* * * * *